US005358679A

United States Patent [19]

Parekh et al.

[11] Patent Number: 5,358,679

[45] Date of Patent: Oct. 25, 1994

[54] MANUFACTURE OF REGENERATED CELLULOSIC FIBER BY ZINC FREE VISCOSE PROCESS

[76] Inventors: Indubhai H. Parekh; Sunanda K. R. Moulik, Both of Birla Research Institute for Applied Sciences Birlagram-456 331, Nagda(M.P), India

[21] Appl. No.: 55,524

[22] Filed: Apr. 29, 1993

[51] Int. Cl.[5] ..... D01F 2/08

[52] U.S. Cl. ..... 264/177.13; 8/101; 106/165; 264/188; 264/195; 264/198; 536/30; 536/60

[58] Field of Search ..... 264/188, 195, 198, 177.13; 8/101; 106/165; 536/30, 60

[56] References Cited

U.S. PATENT DOCUMENTS

| | | | |
|---|---|---|---|
| 4,402,899 | 9/1983 | Hartmann et al. | 264/188 |
| 4,456,749 | 6/1984 | Mandell et al. | 536/30 |
| 4,583,984 | 4/1986 | Turunen et al. | 264/195 X |

FOREIGN PATENT DOCUMENTS

| | | | |
|---|---|---|---|
| 825695 | 4/1981 | U.S.S.R. | 264/188 |
| 852978 | 8/1981 | U.S.S.R. | 264/188 |
| 905345 | 2/1982 | U.S.S.R. | 264/188 |
| 933835 | 6/1982 | U.S.S.R. | 264/188 |

OTHER PUBLICATIONS

Translation of U.S.S.R. 825,695 (Published Apr., 1981).
Translation of U.S.S.R. 852,978 (Published Aug., 1981).
Translation of U.S.S.R. 905,345 (Published Feb., 1982).
Translation of U.S.S.R. 933,835 (Published Jun., 1982).

*Primary Examiner*—Leo B. Tentoni
*Attorney, Agent, or Firm*—Helfgott & Karas

[57] ABSTRACT

A process for the production of rayon fibers. The viscose solution is spun into a spinbath which is acidic in character but has no zinc salt like conventional baths. The spin bath contains sulphuric acid, aluminum sulphate and sodium sulphate. The spinning is at temperatures of 35°-60° C. Usual stretching and post spinning operations are carried out as necessary. The regenerated cellulose fibers obtained are of novel cross-sections, namely of 'c' cross section not achieved ever before. The fibers exhibit increased luster and softness.

2 Claims, 1 Drawing Sheet

MANUFACTURE OF REGENERATED CELLULOSIC FIBER BY ZINC FREE VISCOSE PROCESS

BACKGROUND OF THE INVENTION

1. Field of the Invention

The present invention relates to the production of rayon fibres, filaments or films with a viscose process. More particularly, it relates to an improved process for spinning a viscose solution into an acidic spinbath containing no zinc salt.

2. Description of the Related Art

The production of regenerated cellulosic products like rayon fibre, films and filaments by viscose process, involves an initial step the conversion of a cellulosic material to alkali cellulose by treatment with caustic soda solution. The alkali cellulose is then shredded, aged and further converted into cellulose xanthate by treatment with carbon disulphide. The xanthated cellulose is then dissolved in dilute sodium hydroxide solution to obtain desired content of cellulose and alkali. The solution so obtained is called viscose which is further filtered, ripened, deaerated and then extruded through a spinnerette into a spin bath mainly comprising of sulphuric acid, zinc sulphate and sodium sulphate.

The spinbath of conventional process essentially contains zinc sulphate or some other soluble zinc salts which acts as a regeneration retardant. Zinc salts present in either viscose or in spinbath forms zinc xanthate salts in the filament, which is a more stable compound than sodium cellulose xanthate and thereby allows the stretching phenomenon of filaments. Zinc is known to be highly toxic chemical and the presence of even in ppm range in effluent is objectionable specially for drinking purposes and marine lives. Other than pollution problem, the high use of zinc sulphate in viscose process has certain other notable disadvantages. It is expensive and it has also, to a certain degree, the tendency to form encrusting deposits on spinning equipments.

In addition to zinc sulphate in spin bath, the other viscose modifiers are also used like polyethylene glycols, polyethylene oxides, certain amines, formaldehyde, etc. as auxiliary regeneration retardants, specially when high strength fibres are required. All these viscose organic modifiers not only cause processing difficulties but also pose a serious problem of air and stream pollution. They are also associated with adverse physiological effects.

It was, therefore, thought desirable at least in certain commercial applications like production of regular rayon to develop a process which is completely zinc free.

SUMMARY OF THE INVENTION

It is, therefore, a primary object of the present invention to develop a completely zinc-free viscose process to manufacture regenerated cellulosic fibre.

It is therefore, another object of the present invention to provide a process and spinbath system with reduced stream and air pollution.

It is a further object of this invention to propose a novel process which eliminate zinc or zinc salts in the viscose solution and the spin bath but still provides satisfactory regeneration retardation such that necessary strength can be imparted to the fiber being extruded through the spin bath.

It is yet another object of this invention to propose such a process which will employ readily available chemicals in the spin bath which will be cheap and thereby make the process economical and also reliable.

A further object of the invention is to provide a viscose rayon manufacturing process and a spin bath solution in a said process which promotes the filament hydration and xanthate stability in a manner similar to that of zinc but without the disadvantages associated with zinc namely generation of pollutant stream and encrustation format on spinnerettes or spin bath pipings.

Yet another object of this invention is to provide a process to produce fibres of improved characteristics with respect to lustre, softness and handle.

It is also an object of this invention to eliminate zinc salt in existing viscose industries without adversely affecting the production.

Yet another object of the present invention is to provide a zinc free viscose process to produce normal rayon of variety of quality like fibres of different deniers, length, dope dyed (pigmented) and other ranges of regular rayon.

Yet another important object of this invention is to provide a process to produce fibres with improved dye absorption characteristics.

A still further object of the invention is to propose such an improved process in which there is no additive used in the preparation of the viscose solution.

Thus, it is yet another object of this invention to propose an improved process for the production of viscose rayon in which no additive is used in the preparation of the viscose solution and use of zinc or zinc salts is totally eliminated in the spin bath as regeneration retardants.

Other objects and advantages of the present invention will be apparent from the following description.

In achieving our goal, we have tried many bivalent and trivalent metal ions such as magnesium sulphate, ferrous sulphate, aluminium sulphate (alum), etc. and also some organic compound such as urea and the decomposition rate constant of cellulose xanthate was studied. As a result of extensive experiments carried out to replace a toxic zinc compound from the spin bath with a non-toxic compound, we found that aluminium sulphate (alum) as the best suited chemical which is also found economical and environmentally compatible over zinc sulphate. Effluent pollution is also appreciably reduced.

The regular rayon fibre cross section is serrated and non-uniform. The geometry of the cross section of the filament has a great influence on quite a few important characteristics e.g. lustre, cover, handle and feel. It is known that uniform and non-serrated cross section with 'C' shaped or flat produces fibres of high lustrous appearance.

It has been observed that the process developed by us has enabled us to achieve one goal and convinced us that zinc sulphate can easily be replaced by alum in the spin bath solution without facing any problem in the running plant by stopping the make up addition of zinc salt and gradual addition of aluminium sulphate in the spin bath.

We have further observed that we are able to produce fibres with uniform 'C' shaped cross-section thus ensuring improved optical properties.

We have still further observed that the dye affinity of the fibres of present invention is greater than fibres of zinc process and requires less amount of dye to get similar dyeing effect as regular rayon of zinc process.

In conventional process of producing viscose rayon fibre, the presence of zinc salts in viscose or spin bath is essential, as the formation of the skin structure of the filament depends upon the formation of zinc cellulose xanthate. It is also claimed that the zinc compound causes substantial increase in the plasticity of zinc cellulose xanthate gel so it can be stretched much more rapidly than sodium-cellulose-xanthate. Although many theories have been proposed to explain the importance of zinc and zinc-cellulose-xanthate in the structural formation of filaments in viscose process, but however, it is still an open question whet her or not zinc-cellulose-xanthate plays any vital role in subsequent structure formation.

There are mentions that in some cases the acidic spin bath does not contain zinc salt, but to compensate the effect of zinc, many tertiary mono-amine such as methylol, dimethylamine, methylol metha methyl amine, methylol diethylamine or other amines like dimethylamines, aldehydes like formaldehyde are used either in viscose or in spin bath as a regeneration retardant or additives in spin bath. All these modifiers are associates either in one way or other with high cost or air or stream pollution. No practical method has been devised for the recovery of these additives from the spin bath and accordingly, there is a gradual build up of the additives or their reaction products in the spin bath and thereby these are present in effluent wash water routed to the waste treatment. This is highly undesirable because they add appreciably to the biological oxygen demand (B.O.D.) which must be lowered to a level to meet standards established by Central and State agencies.

There are also some mentions where aluminium compounds are suggested for use in the spin bath with or without zinc sulphate, but none of these approaches have reached upto commercialization stage.

Briefly stated our invention provides a process for the production of regenerated cellulose fibre having increased lustre and softness and having substantially 'C' cross section with well developed skin which comprises soaking a rayon grade pulp in caustic soda solution of 17.5 to 18.5% to produce alkali cellulose having 33–34% cellulose and 15.55 to 16.00% sodium hydroxide, shredding the alkali cellulose, ageing same to get a viscous solution having viscosity of 35–75 ball fall seconds, converting the alkali cellulose into cellulose xanthate by reaction with 28 to 33% carbon di-sulphide, preparing a viscose solution from the xanthate by dissolving same in dilute caustic soda solution, said viscose solution having 6–11% cellulose and 52–60% caustic soda/cellulose ratio, allowing the viscose solution to ripen and thereafter subjecting the ripened solution to spinning in a spin bath characterized in that the spin bath is zinc free spin bath containing 6.5–12% sulphuric acid, 0.3–2.0% aluminium sulphate [$Al_2(SO_4)_3$] and 16–26% sodium sulphate followed by stretching the spun filament and thereafter, regenerating, desulphurizing, bleaching, finishing and drying the filament.

Still more particularly the following steps are followed in our process.

A rayon grade pulp is steeped in 17.5–18.5% caustic soda solution. Excess alkali is removed by pressing to a suitable extent to get alkali cellulose having 33–34% cellulose and 15.5–16% sodium hydroxide. Alkali cellulose is shredded and aged to get desired viscosity of 35–75 ball fall sec. Alkali cellulose is then treated with 28–33% carbon disulphide. The cellulose xanthate so formed is dissolved in dilute caustic soda solution to prepare a viscose containing 6–11% cellulose and 52–60% caustic soda/cellulose ratio. The viscose prepared is filtered, deaerated, and ripened to get 7–12 Hottonroth number. It is spun in a spin bath containing 6.5–12% sulphuric acid, 0.3–2.0% aluminium sulphate ($Al_2(SO_4)_3$) and 18–26% sodium sulphate. Other metal salts such as magnesium sulphate, ferrous sulphate may also be used. In the spinning process zinc salt is totally eliminated. Spin bath temperature from 35°–60° C. and spinning speed of 30 to 75 m/min can be kept. Filaments so formed can be stretched to 35–70% in air. Fibre/filaments are then completely regenerated desulphurised, bleached, finished and dried in a usual manner.

The cross section of the fibres prepared by the process of present invention (i.e. alum process) is shown in FIG. 1 of the accompanying drawings compared with regular rayon of zinc process and HWM zinc process fibre. From the figures, it is clear evidence that the fibres of present process have uniform 'C' shaped cross section with well developed skin and some folded section in between. Such cross section also showed increased lustre and soft feel.

There are a few paper suggestions in the prior art where the use of zinc or zinc salts has sought to be replaced by aluminium salts.

One such prior art suggests the use of high concentrations of aluminium sulphate which can be about half of or equal to the amount of sulphuric acid present in the spin bath. This prior art further suggests the use of additives like aluminium hydroxide in the viscose solution. This combination of aluminium salts has not enabled a commercially viable process. Moreover, the properties of the rayon fibre are not as enhanced as those of the invented process.

Another prior art suggests use of a specially prepared viscose base alkali solution which involves special neutralization techniques using sodium carbonate and sodium hydroxide. The spin bath suggested aluminium sulphate. The viscose base solution is thus to be specially prepared as otherwise the precipitation of the fibres in the spin bath can not be achieved. This process is also not commercially viable and renders the process very costly because of the requirement of special equipments centrifuge and chemicals in the preparation of the viscose base solution.

A third prior art process suggests the use of an aqueous precipitating bath which employs equal amounts of sulphuric acid and aluminium sulphate. There is a possibility of using aluminium sulphate in amounts upto double that of sulphuric acid. In addition to the above the process proposes to use organic compounds like naphthalene sulfonic acid in substantial amounts. This makes the process very complicated and expensive.

In a fourth prior art (C.A.-99-1983-5 4949d) the effect of ions of polyvalent metals on the decomposition rate of cellulose xanthate in a coagulating bath has been studied. It suggests the replacement of zinc salts in the spin bath with equal amounts of aluminium sulphate. Thus, the amounts of aluminium sulphate is about 20% of the amount of sulphuric acid which is very high percentage. The study shown reduction in hydrolysis of the xanthate. Obviously, there is nothing on fibre properties and obtaining C-cross section fibre.

A fifth prior art process recommends the use of a spinning bath having usual sulphuric acid, sodium sulphate and zinc sulphate and in addition substantial amounts of aluminium sulphate which is triple the amount of zinc sulphate. Such a process does not avoid zinc salts and hence the fibre properties are influenced by the presence of zinc salts.

A sixth prior art however recommends use of zinc free coagulation bath containing polyvalent metal ions. The bath composition has very high concentrations of polyvalent metal ions like Aluminium. However because of the use of such high concentrations of polyvalent metal ions, the ultimate properties of the spun fiber obtained are far from satisfactory and the prior art fibers do not combine all the properties of the fiber obtained by the process of the present invention.

Yet another seventh prior art is again a paper work which suggests the replacement of zinc sulphate in the spinning bath by aluminium sulphate. No details are available. However if aluminium sulphate is used to replace zinc sulphate, the amount ought to be substantial.

We have, by conducting experiments have found that high lustrous fiber "C" character cannot be obtained by any of the prior art suggestions. It is also not possible to combine other beneficial properties like high strength, crimp and slowing of retardation of regeneration and high stretchability and dye affinity.

Quite unexpectedly and surprisingly it has been discovered by us by extensive research that a unique process can be achieved producing a fiber having all the beneficial properties and particularly "C" character in addition to reducing environmental pollution if the spinning bath composition is correlated to its components and the aluminium sulphate amount kept as low as possible.

We have further discovered that the mere optimisation of amount of aluminium sulphate will not work and that its amount should be co-related to the amounts of the other ingredients so as to give a balanced spinning bath capable of ensuring quick precipitation of the fiber, retarded regeneration of viscose, easy and efficient solidification of precipitated viscose, high spinnability and stretchability high lustour, smooth fiber surface characteristics, soft feel of fiber on handling, less use of chemicals and repeatability.

There is no process to our knowledge anywhere practiced or anywhere published or even suggestive which will combine all the above properties and on top of its produce "C" character fiber. This is borne out by the Examples given herein.

Use of aluminium sulphate in amounts less than 0.3% will not ensure sat is factory regeneration retardation. Use of aluminium Sulphate in amount more than 2.0% will hamper with the production of "C" cross section fiber thereby affecting the lustrous character. Further the amount of aluminium sulphate should be as low as 1/10th to 1/90th of Sodium Sulphate and 1/5th to 1/50th of Sulphuric acid.

Such low amounts of aluminium Sulphate only help in obtaining a commercially viable, highly dependable and repeatable process.

In searching leas expensive and non toxic chemicals, we found aluminium sulphate (alum) as the best suited compound to replace zinc totally from the spin bath. The alkali soluble aluminium compounds like aluminium sulphate, aluminium hydroxide or sodium aluminate in small quantities can further be added in the viscose to serve as a dispersing agent and act as an auxiliary supporter to slow down the decomposition rate constant of xanthate in spinning process.

In course of our experimental investigations, we have discovered a method for commercial production of regular rayon where zinc compound is eliminated completely from the process with the use of aluminium sulphate in the spin bath. Viscose may or may not contain any additives.

The invention is carried out by the spinning of viscose in zinc free spin bath containing alum under conditions which result in filament having appreciable amount of skin equivalent to or even more than that of produced by the presence of zinc sulphate. The stretchability of the newly formed tow does not suppress when alum is present in the spinbath. The viscose filaments are spun into an acidic spinbath containing sulphuric acid, sodium sulphate and aluminium sulphate and subjected to air stretching to an extent of 35 to 70%. The filaments or staples are then completely regenerated in dilute acidic aqueous bath at 80°–100° C. The further refining stages like desulphurization, bleaching, finishing are done in a conventional manner.

In carrying out the viscose spinning of present invention, we may use any suitable viscose composition of the well known procedure for forming rayon filaments. It is preferred in preparing the viscose to use cellulose having uniform D.P. distribution of from 300 to 1000 DP made by kraft, sulphite, cotton linter or cold caustic refined pulps. The process may be carried out with conventional or modified viscose composition comprising about 6–11% cellulose and 52–60% caustic soda/-cellulose ratio. The viscose solution may be prepared according to the usual practice to have a ripening index 7°–12° H. by xanthating the alkali cellulose with desired amount of Carbon disulphide, say 28 to 33%.

It is also preferred to spin the viscose into a zinc free spinbath containing 6.5 to 12% sulphuric acid, 18 to 28% sodium sulphate and 0.3–2.0% aluminium sulphate at temperature 35° to 60° C. The filaments so formed are stretched in air to a desirable extent, say 35 to 70%.

The presence of aluminium sulphate in spinbath of alum process does not exhibit any problem in $CS_2$ or salt recovery system, on the contrary it increases the release of $CS_2$ and $H_2S$ gases compared with the spinbath containing zinc sulphate. $Al_2(SO_4)_3$ in spinbath is also found to be economic and environmentally beneficial over zinc sulphate. The effluent pollution is appreciably reduced.

The invention will be further described by means of following specific examples which are given for illustration only and are not to be taken as, in any way, limiting to the invention.

BRIEF DESCRIPTION OF THE DRAWINGS

In the accompanying photomicrograph

DESCRIPTION OF THE PREFERRED EMBODIMENT

EXAMPLE 1

Figure 1:
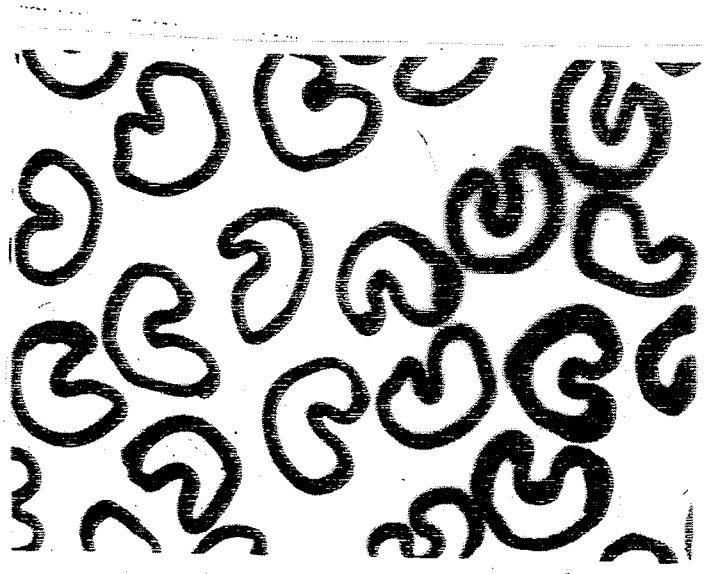
FIG. 1 is enlarged (about 1000×) cross sectional view of the fibres of present invention (alum process).
Figure 2:
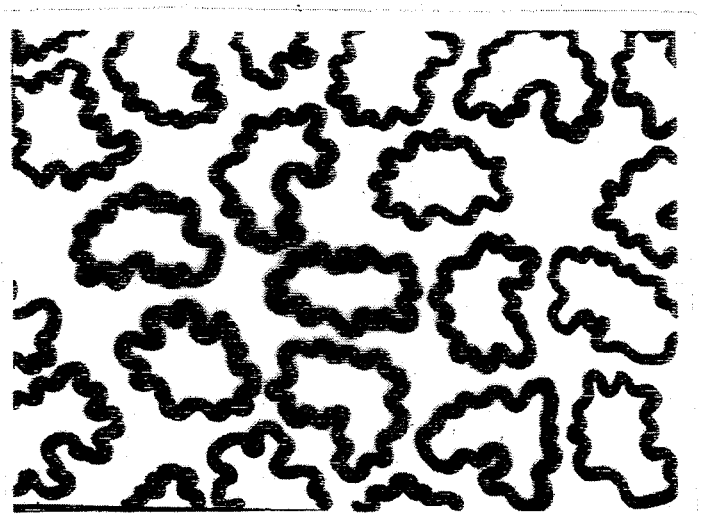
FIG. 2 is an enlarged (about 1000×) cross sectional view of the regular rayon fibres prepared by zinc process (i.e. $ZnSO_4$ in spinbath.
Figure 3:
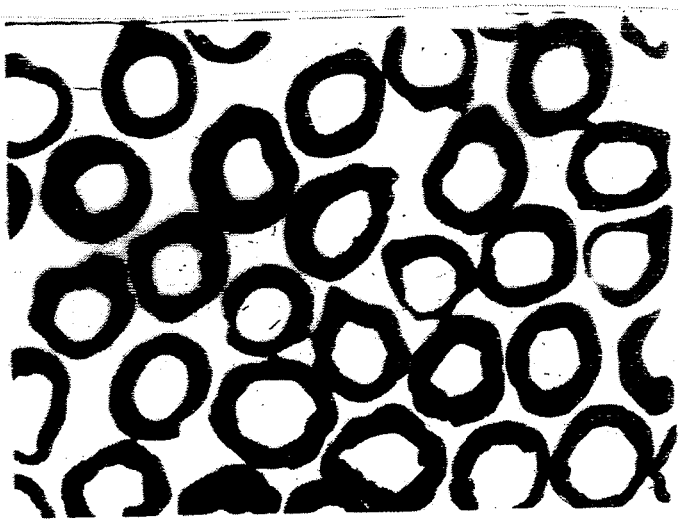
FIG. 3 is an enlarged (about 1000×) cross sectional photomicrograph of commercial HWM fibres.

Normal rayon grade pulp was steeped in 17.5% sodium hydroxide solution, the excess alkali was removed by pressing. The alkali cellulose so obtained was shredded and aged. The aged alkali cellulose was treated with 30% Carbon disulphide on the basis of alpha cellulose present in the alkali cellulose. The sodium cellulose xanthate so formed was then dissolved in dilute caustic soda solution to form viscose. The viscose contained 10% cellulose and 5.8% sodium hydroxide having ball fall 55 sec. It was then filtered, deaerated and ripened to 10° H. Ripened viscose was extruded into a spinbath containing 8% sulphuric acid, 23% sodium sulphate and 0.46% aluminium sulphate at temperature 50° C. The spinbath was free from zinc salt. The filaments were stretched 40–60% in air and cut into staples. The fibres were then completely regenerated in acidic aqueous bath 95° C., desulphurized, bleached and finished and dried in a conventional way. The fibre so obtained has following properties in addition to having C-crossed section

| | |
|---|---|
| Denier | 1.51 |
| Cond. tenacity gpd | 2.63 |
| Wet tenacity gpd | 1.35 |
| Wet/Cond. ratio % | 51.4 |
| Cond. elongation % | 20.8 |
| Wet elongation % | 23.6 |

EXAMPLE 2

Viscose was prepared in the same manner as described in Example 1 excepting that NaOH was % and $CS_2$ was %. The cellulose content in the viscose was 9.5% and alkali 5.4%. Viscose viscosity at the time of spinning was 48 ball fall sec. at 20° C. Viscose was extruded into a spinbath containing 95 gpl sulphuric acid, 6 gpl aluminium sulphate and 290 gpl sodium sulphate at 48° C. The newly formed filaments of 1.2 denier were stretched to 48% in air and given usual refining and finishing treatments. The fibres have good lustre, soft hand and feel with 'C' shaped cross section. The fibres have following physical properties:

| | |
|---|---|
| Denier | 1.17 |
| Cond. tenacity gpd | 2.50 |
| Wet tenacity gpd | 1.24 |
| Wet/Cond. ratio % | 49.7 |
| Cond. elongation % | 17.5 |
| Wet elongation % | 22.0 |

EXAMPLE 3

A viscose solution as described in Example 1 using indigenous pulp having ripening index 9.6° H. was spun for 3 denier fibre by extrusion into a spinbath containing 8.5% sulphuric acid, 0.46% $Al_2(SO_4)_3$ and 23% sodium sulphate. Spinbath was maintained at 50° C. and spinning machine speed was 45 m/min. Filaments were stretched to abut 47% in air, cut into staples and usual fibre refinings were carried out.

The fibres have smooth almost non-serrated surface with 'C' shaped cross section. Other physical characteristics are given below:

| | |
|---|---|
| Denier | 3.30 |
| Cond. tenacity gpd | 2.35 |
| Wet tenacity gpd | 1.22 |
| Wet/Cond. ratio % | 51.9 |
| Cond. elongation % | 20.0 |
| Wet elongation % | 23.3 |

EXAMPLE 4 viscose solution with 10.3% cellulose and 5.7% alkali was prepared with 30% Carbon disulphide having viscosity of 57 ball fall sec.

It was filtered, deaerated and ripened to 10.3° H. This viscose was extruded into a spinbath containing 7.7% sulphuric acid, 1.1% aluminium sulphate and 22.5% sodium sulphate at temperature 47° C. Filaments were stretched to 52% in air. Normal refining treatment as described in Example 1, was given to fibres. The fibres have following properties in addition to having C-shaped cross section.

| | |
|---|---|
| Denier | 1.53 |
| Cond. Tenacity gpd | 2.60 |
| Wet Tenacity gpd | 1.31 |
| Wet/cond. ratio % | 50.5 |
| Cond. elongation % | 20.0 |
| Wet elongation % | 23.5 |

EXAMPLE 5

Viscose A and B were prepared as in Example 1 and 2 and spun in a spinbath containing 95–100 gpl sulphuric acid, 6 gpl aluminium sulphate and 290 gpl sodium sulphate through a spinnerette having 19000 holes 70 micron orifice dia. Spinning conditions were set for 1.15 D and 1.5 Denier fibre, stretched 50% in air and cut into staples A and B of 44 mm length. The cut fibres A and B were separately regenerated completely, desulphurized, bleached, finished and dried in usual manner. The fibres were tested for dye affinity and yarn strength.

| | FIBER A | FIBER B |
|---|---|---|
| Fiber quality | 1.15 D × 44 mm | 1.5 D × 44 mm |
| Denier | 1.13 | 1.41 |
| Cond. tenacity gpd | 2.67 | 2.38 |
| Wet tenacity gpd | 1.32 | 1.18 |
| Wet/Cond. ratio % | 49.3 | 49.4 |
| Cond. elongation % | 19.0 | 18.8 |
| Wet elongation % | 23.8 | 22.0 |
| Yarn Strength: | | |
| Spinning count | 40 | 40 |
| Lea test (lbs) | 57.6 | 53.4 |
| C.S.P. | 2304 | 2136 |
| Dye affinity | Greater than regular rayon of Zinc process Good fastness bright shade | Greater than regular rayon of Zinc process Good fastness bright shade |
| Handle/feel | pleasant hand/ soft feel | pleasant hand/ soft feel. |

The action of acid salts is to reduce the speed of regeneration. The most important, however, is the dehydrating and salting out action, which is common to all melts. The ammonium salts have greater coagulating power than sodium salts, whereas the coagulating power of $Mg^{++}$ is of the same order as $Na^{+}$. The heavy metals like $Zn^{++}$, $Fe^{++}$ are more effective than $Na^{+}$ or $Mg^{++}$. The regeneration retardation of these cations is about the same order as their coagulating power. Further a very significant effect along these lines is obtained with aluminium salts especially aluminium sulphate.

Invented processes have been successfully tried for commercial production of various quality of fibres with denier ranging from 0.8 to 12.

EXAMPLE 6

Viscose prepared as described in Example 1, having salt index 10° H. was spun in two different spinbaths.

Sample A was spun in a bath containing 8.5% sulphuric acid 0.5% Magnesium sulphate and 23% sodium sulphate at 49° C. The filaments were stretched to 42%.

Sample B was spun in a spinbath containing 8.5% sulphuric acid 0.5% ferrous sulphate and 22.5% sodium sulphate at 49° C. Filaments stretched to 45%. The tow stretchability in case of $MgSO_4$ has been reduced to some extent whereas the reduction in fibre brightness was observed, in case of $FeSO_4$ in spinbath. Fibre cross-section in both cases were irregular with some folds in one or two sides. Fibre properties are mentioned below:

| | Sample A | Sample B |
|---|---|---|
| Denier | 1.57 | 1.45 |
| Tenacity gpd conditioned | 2.54 | 2.52 |
| wet | 1.22 | 1.24 |
| W/C Ratio % | 48.0 | 49.2 |
| Elongation % | | |
| Conditioned | 19.5 | 18.7 |
| Wet | 22.6 | 23.8 |

EXAMPLE 7

Successful commercial trial has been taken with a viscose prepared as described in Example 1, and spun in a spinbath containing 7.8–10% sulphuric acid, 0.4–0.6% aluminium sulphate and 22–24% sodium sulphate at 46°–49° C. Fibres have been given normal desulphurization, bleaching and finish treatments. Remarkable improvement in brightness, lustre and soft feel was observed over normal fibre of zinc-process. Fibre properties are given below:

| Fiber quality | A 1.5 D × 57 mm BB | B 1.2 D × 51 mm | C 0.8 D × 51 mm | D 12 D × 51 mm |
|---|---|---|---|---|
| Denier | 1.51 | 1.16 | 0.9 | 11.7 |
| Tenacity gpd | | | | |
| Conditioned | 2.54 | 2.57 | 2.59 | 1.75 |
| Wet | 1.31 | 1.37 | 1.32 | 0.71 |
| W/C ratio % | 51.7 | 53.0 | 51.0 | 40.6 |
| Elongation % | | | | |
| Conditioned | 19.1 | 18.1 | 18.4 | 28.5 |
| Wet | 23.2 | 19.3 | 18.9 | 34.6 |
| Crimp % | 12 | 12 | 16 | 12 |
| Yarn strength (of 40's) CSP | 1836 | 2076 | 2100 | — |

All fibers had C-shaped cross section.

Though we have discussed the details of use of aluminium sulphate to replace the zinc salt, it is possible to use other bivalent and trivalent metal ions, such as magnesium sulphate or ferrous sulphate instead of aluminium sulphate. Other suitable similar compounds can also be used under necessary conditions. These compounds can be used either alone or with suitable mixtures thereof of.

We claim:

1. A process for the production of regenerated cellulose fibre having increased lustre and softness and having substantially "C" cross section with well developed skin which comprises soaking a rayon grade pulp in caustic soda solution of 17.5 to 18.5% to produce alkali cellulose having 33–34% cellulose and 15.55 to 16.00% sodium hydroxide, shredding the alkali cellulose, aging same to get a viscous solution having viscosity of 35–75 ball fall seconds, converting the alkali cellulose into cellulose xanthate by reaction with 28 to 33% carbon-di-sulphide, preparing a viscose solution from the xanthate by dissolving same in dilute caustic soda solution, said viscose solution having 6–11% cellulose and 52–60% caustic soda/cellulose, allowing the viscose solution to ripen and thereafter subjecting the ripened solution to spinning in a spin bath containing 6.5–12% sulphuric acid, 0.3–2.0% aluminium sulphate [$(Al_2(SO_4)_3)$] and 18–26% sodium sulphate followed by stretching the spun filament and thereafter, regenerating, desulphurizing, bleaching, finishing and drying the filament in a conventional manner.

2. A process as claimed in claim 1 wherein the spin bath temperature is maintained during spinning at 35°–60° C. and the spinning speed is maintained at 35 to 75 meters per minute and the formed filaments are air stretched to 35–70%.

* * * * *